United States Patent [19]

Fette

[11] 4,392,018

[45] Jul. 5, 1983

[54] SPEECH SYNTHESIZER WITH SMOOTH LINEAR INTERPOLATION

[75] Inventor: Bruce Fette, Mesa, Ariz.

[73] Assignee: Motorola Inc., Schaumburg, Ill.

[21] Appl. No.: 267,203

[22] Filed: May 26, 1981

[51] Int. Cl.[3] ..... G10L 1/00

[52] U.S. Cl. ..... 179/1 SM

[58] Field of Search ..... 179/1 SM, 1 SG, 1 D; 364/513, 725

[56] References Cited

U.S. PATENT DOCUMENTS 4,328,395 5/1982 Henderson ..... 179/1 SM

*Primary Examiner*—Emanuel S. Kemeny

*Attorney, Agent, or Firm*—Eugene A. Parsons

[57] ABSTRACT

A linear predictive coding (LPC) voice synthesizer formed as an integrated circuit on a single semiconductor chip, which circuit is programmed to provide the all pole lattice filter method of speech synthesis. The apparatus smoothly interpolates between correlation coefficients during the synthesis operation.

9 Claims, 4 Drawing Figures

SEQUENCE COUNTER
37
SEQUENCE ROM
39
PIPE REGISTER
40
MUX
30
TEST
43
POWER ON RESET
34
JUMP DECISION LOGIC
33
FILTER SECTION COUNTER
35
DECODER
97
FR
TEMP 1
TEMP 2
93
94
95
VOICE OUT REG
110
12
111
CONTROL
113
115
NEW SAMPLE OUT
45
60
CONTROL
106
B
A
105
+ −
OV LIMIT
S
CONTROL
101
Y
X
100
X
ACC
P
DECODER
91
BR
90
11
16

SPEECH SYNTHESIZER WITH SMOOTH LINEAR INTERPOLATION

BACKGROUND OF THE INVENTION

Linear predictive coding (LPC) is one of the more important tools used in the processing of voice information. LPC is a mathematical procedure for estimating a filter function equivalent to the vocal tract. The estimate of the vocal tract resonance may be used to subtract vocal tract resonances from speech leaving an estimate of the excitation. The vocal tract function is estimated by removing correlation between a number of adjacent samples of the speech waveform; assuming that the waveform may be modeled as exponentially decaying sinusoids. The model for decaying sinusoids may be derived by inverting a correlation matrix (an all pole lattice digital filter) to provide an all zero lattice digital filter. The LPC correlation, excitation, and amplitude information are each individually quantized and transmitted typically at between 1200 and 4800 bits per second depending on desired speech fidelity, system complexity, and system throughput constraints. Typical apparatus for providing the LPC correlation, excitation, and amplitude information is disclosed in a copending application entitled "Human Voice Analyzing Apparatus", filed of even date herewith and assigned to the same assignee.

The quantized LPC correlation, excitation, and amplitude information is supplied to a voice synthesizer which synthesizes or reconstructs the voice from the quantized information. The speech synthesis can be performed by any of several different methods including the all pole lattice filter method (basically the inverse of the all zero voice analysis method), cascaded second order filter, direct form filter, pole and zero filter, etc. Prior art synthesizers have the disadvantage of being limited to a specific type of voice synthesis and, in general, are limited to a very narrow type of applications. That is, prior art synthesizers which are constructed on a single semiconductor chip are generally not capable of full fidelity reproduction of a human voice.

SUMMARY OF THE INVENTION

The present invention pertains to a speech synthesizer formed as an integrated circuit on a single semiconductor chip with flexibility to allow variable bit rates for variable fidelity and programmable to allow for several different methods for speech synthesis, said synthesizer including apparatus for smoothly interpolating between sets of correlation coefficients and further including an input first-in first-out memory for reducing dependence upon the speed of the information transmission, and shift registers utilized as storage units to eliminate the need for address calculation arithmetic and circuitry.

It is an object of the present invention to provide a new and improved speech synthesizer formed as an integrated circuit on a single semiconductor chip, which synthesizer has improved versatility and fidelity.

It is a further object of the present invention to provide a speech synthesizer which incorporates a variety of circuits and functions to substantially reduce the overall apparatus and improve the operation thereon.

These and other objects of this invention will become apparent to those skilled in the art upon consideration of the accompanying specification, claims and drawings.

BRIEF DESCRIPTION OF THE DRAWINGS

Referring to the Drawings.

DESCRIPTION OF THE PREFERRED EMBODIMENT

Figure 1:
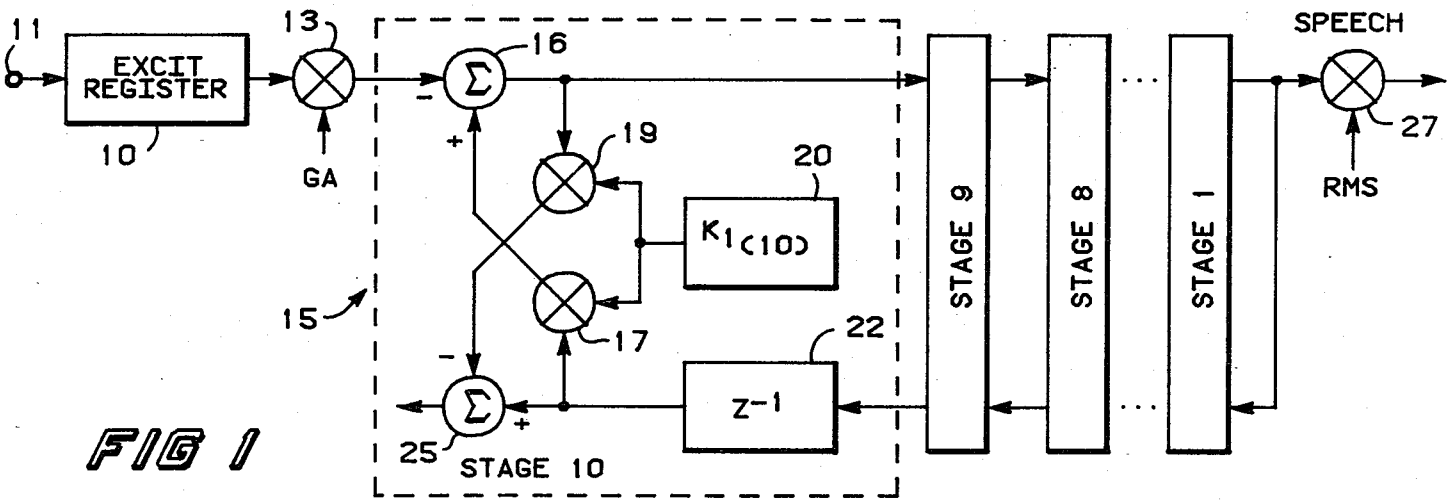
FIG. 1 is a flow diagram of voice synthesizer apparatus.

Referring specifically to FIG. 1, LPC excitation signals are applied to an excitation register 10 by way of an input terminal 11. The excitation signal from the register 10 is supplied to one input of a multiplier 13, the other input of which is a signal GA. Unlike the voice analyzer (above described copending application) whose inverse filter gain is less than unity, the synthesizer gain is greater than unity. This gain must be accommodated to prevent significant and continuous overflows in subsequent operations. The signal GA is developed externally in accordance with the following equation.

$$GA = \frac{1}{\sqrt{(1 - K_1^2)(1 - K_2^2)\ldots(1 - K_{10}^2)}}$$

The gain adjusted excitation signal from the multiplier 13 is applied to the tenth stage, generally designated 15, of an all pole lattice filter as a forward residual, $f_r$, signal. Each of the ten stages of the lattice filter are substantially identical and, therefore, only the tenth stage will be described in detail.

The forward residual signal from the multiplier 13 is applied to one input of a combining circuit 16, a second input of which is obtained from the output of a multiplier 17. The output of the combining device 16 is supplied as an input to a second multiplier 19 and also is the forward residual output of the tenth stage ($f_r$10). Both of the multipliers 17 and 19 receive a signal, $K_{10}$, representative of the tenth correlation coefficient from a smooth interpolation circuit 20. A backward residual signal, $b_r$, is supplied to a delay network 22, which delays the backward residual signal by one sample time and the output thereof is connected to a second input of the multiplier 17 and a positive input of a combining circuit 25. The combining circuit 25 also receives an input from the multiplier 19 which is subtracted from the backward residual signal applied to the other input to provide a backward residual signal at an output thereof for application to the next stage. Since the tenth stage is the last stage, the backward residual signal from the combining circuit 25 is discarded. However, this illustrates the apparatus for generating the backward residual signal from each of the prior stages. In the first stage the backward residual signal and forward residual signal are the same signal and are essentially reconstructed samples of the voice signal.

The reconstructed voice output signal from the first stage of the lattice filter is applied to a multiplier 27. A second input of the multiplier 27 is the LPC amplitude information (RMS). Amplitude scaling is performed on the output of the filter rather than on the excitation in order to minimize the quantization noise in the filter output, and thereby maximize the signal to noise ratio of the audio or voice.

As is described in more detail in the above referenced copending application, in a speech analyzer the speech may be sampled at a rate of 8000 samples per second and 180 samples may be utilized as a frame, for example. The most accurate ten correlation coefficients are selected in each 180 sample frame to represent the entire frame. In the synthesizer of FIG. 1, the ten stages of the lattice filter reconstruct 180 voice samples for each set of correlation coefficients applied to the lattice filter. As will be seen in conjunction with the block diagram of FIG. 2, in many instances more or less samples per frame can be utilized, if desired, to alter the fidelity of the reconstructed voice.

In many instances the ten correlation coefficients representative of 180 voice samples may differ substantially from the ten correlation coefficients representative of the next 180 voice samples. This substantial step change in the correlation coefficients can have an adverse effect on the reconstructed voice. To eliminate this adverse effect the smooth interpolation circuit 20 (and similar circuit in each of the other nine stages) operates to gradually change the correlation coefficient over the entire frame, or 180 samples, rather than providing a step change on the first sample and maintaining the coefficients constant for the remaining 179 samples. This is accomplished by determining the difference between the old or previous correlation coefficient and the new correlation coefficient, and dividing that difference into a number of steps equal to the number of samples in a frame. The correlation coefficient applied to the two multipliers in the stage is then altered by that amount prior to the reconstruction of each sample. This can be expressed mathematically by the following equation:

$$K_T = K_I \text{ old} + (K_I \text{ new} - K_I \text{ old})\ n/N$$

where:

$K_T$ is the changing correlation coefficient, $K_I$ old is the old correlation coefficient, (the I indicates a general term for the stages)

$K_I$ new is the new correlation coefficient,

N is the number of samples to be reconstructed for each set of correlation coefficients, and n is the particular sample of the N samples being reconstructed.

In the case of N equal to 180 samples, as described above, the correlation coefficient provided by the circuit 20 will change one 180th of the total difference for each sample. Thus, the correlation coefficients will change smoothly over the entire frame and the adverse effects of a step change in the coefficients is eliminated.

Figure 2A:
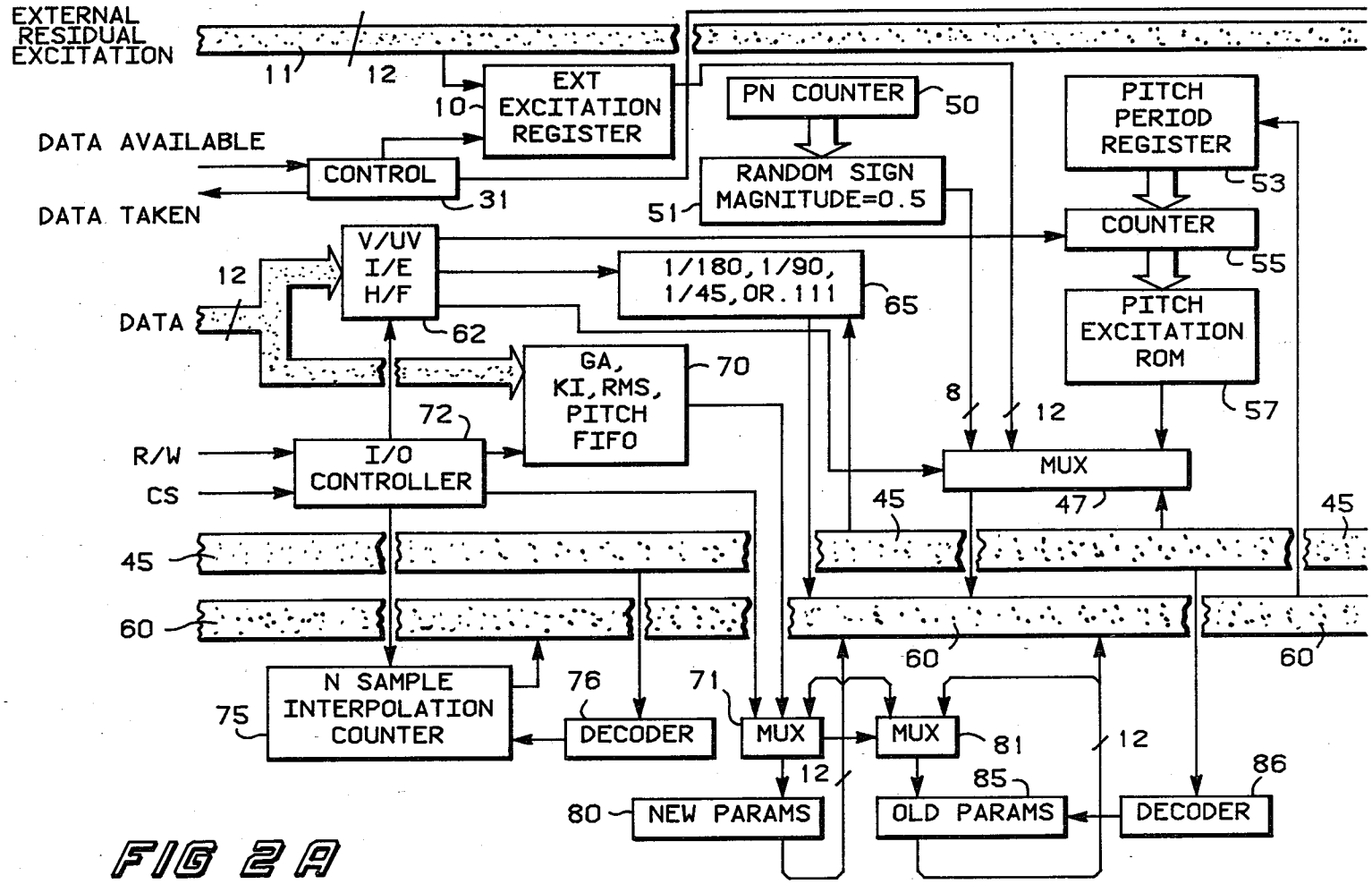
FIGS. 2A and 2B are a block diagram of voice synthesizing apparatus embodying the present invention and formed on a single VLSI chip.
Figure 2B:
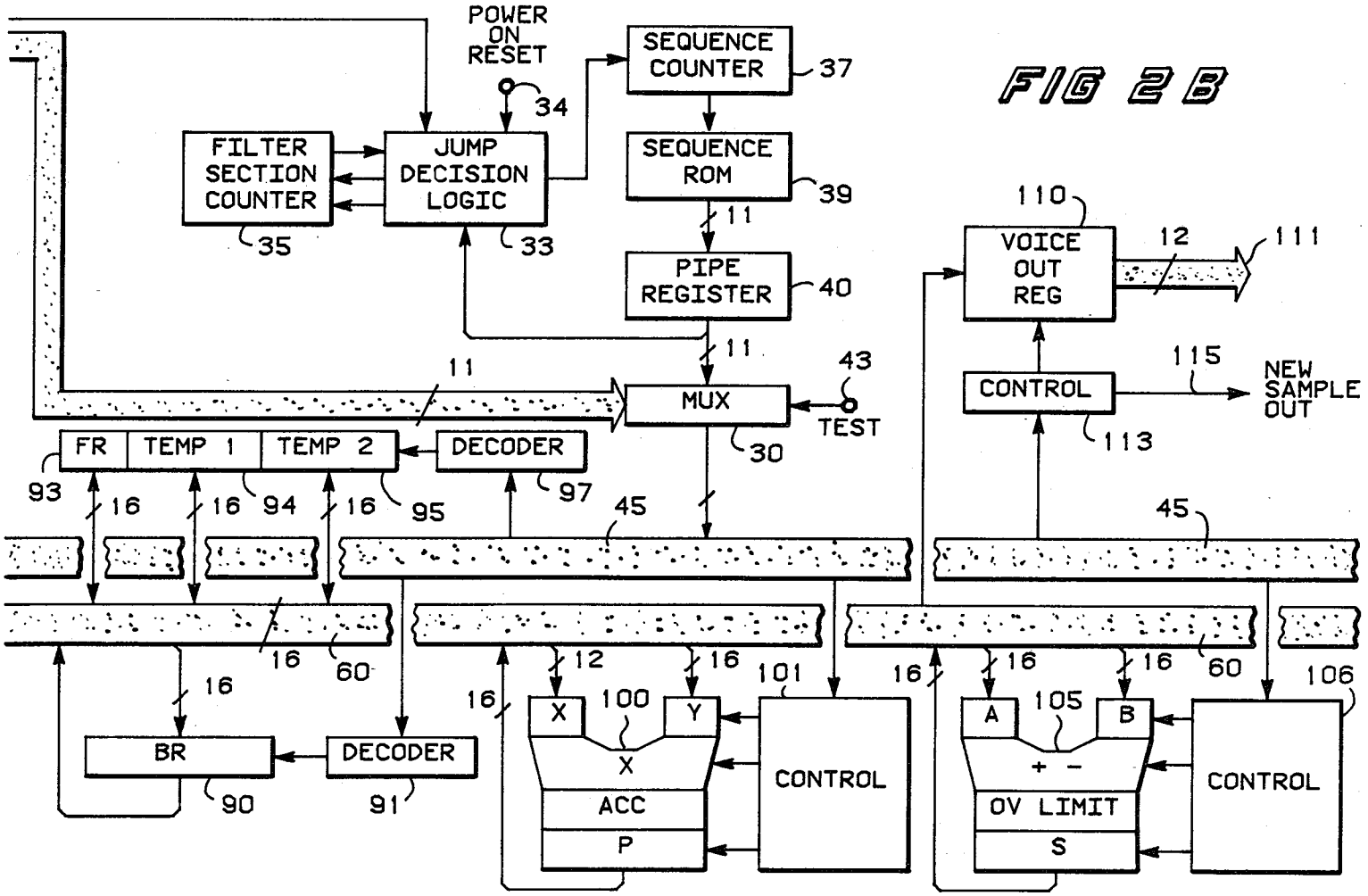

Referring specifically to FIG. 2, the input bus 11 is illustrated as a twelve line bus connected to the external excitation register 10 and to a multiplexing circuit 30. The excitation register 10 is controlled by a control circuit 31 which receives "data available" signals and supplies "data taken" signals on two external lines and also supplies control signals to jump decision logic 33. The jump decision logic 33 receives power on and reset signals on an external terminal 34 and also has a filter section counter 35 associated therewith for determining when jumps in the program are appropriate. The jump decision logic 33 supplies control signals to a sequence counter 37 which in turn supplies signals to a sequence read only memory (ROM) 39. The ROM 39 supplies control signals on an eleven line bus to a pipe register 40 which supplies the signals on an eleven lead bus to the multiplexing unit 30 as well as to the jump decision logic 33. The multiplexing unit 30 also has an external terminal 43 adapted to receive test signals for the entire apparatus. The multiplexing unit 30 supplies control signals from selected ones of the various inputs to a control bus 45.

The external excitation register 10 is connected by way of a twelve line output to a multiplexing circuit 47. A pseudo random noise generator, made up of a thirteen stage PN counter 50 and a random sign circuit 51, also supplies signals to the multiplexing circuit 47 on an eight line input. A third signal is supplied to the multiplexing circuit 47 from a pitch period register 53, counter 55, and pitch excitation ROM 57. The pitch period register 53 receives input data from a data bus 60 and supplies pitch period signals to the counter 55. The counter 55 receives control signals from a voiced/unvoiced circuit 62 and supplies the proper pitch period information to the pitch excitation ROM 57 which in turn supplies the proper coded information to the multiplexing circuit 47. The multiplexer 47 receives control signals from the control bus 45 and supplies information to the data bus 60 in accordance with the control signals. The multiplexing circuit 47 is capable of supplying either internal pitch signals from the ROM 57, pseudo random noise signals from the counter 50, or external excitation signals from the register 10, or any desired combination of the internal and external signals. The voiced/unvoiced circuit 62 receives external signals on a twelve line input bus, which external signals supply the information as to the type and frequency of excitation.

The voiced/unvoiced circuit 62 also supplies signals to a frame determining circuit 65. The circuit 65 provides an output signal to the data bus 60 which is indicative of the number of samples per frame, for the calculation of the smoothly interpolated correlation coefficients. The circuit 65 receives control signals from the control bus 45 for the proper sequencing of the operation. The determination of the proper samples per frame number supplied by the circuit 65 is made in the circuit 62 in response to an external signal supplied thereto.

The twelve line input bus connected to the circuit 62 also supplies input correlation coefficient data and amplitude data (GA, KI, RMS, and PITCH) to a first-in first-out random access memory (RAM) 70. The RAM 70 supplies information to a multiplexing circuit 71. A controller 72 receives external read/write signals and clock signals and supplies control signals to the RAM 70 and the multiplexer 71. The controller 72 also supplies control signals to an interpolation counter 75 which in turn supplies interpolation data to the data bus 60. The interpolation counter 75 also receives signals from an address decoder 76 which receives control signals from the control bus 45.

The multiplex circuit 71 connects a selected data source to a new parameter storage unit 80 or to a second multiplexer 81. The new parameter storage unit is a twelve word, twelve bit shift register with a twelve line output connected to the data bus 60, the multiplex circuit 71 and the multiplex circuit 81. The multiplex circuit 81 connects a selected source of data to an old parameter storage unit 85 which is also a twelve word, twelve bit shift register having a twelve line output connected to the data bus 60 and an input of the multiplexing circuit 81. An address decoder circuit 86 supplies signals to the old parameter storage unit 85 in response to control signals from the control bus 45. A backward residual storage unit 90, which in this embodiment is a twelve word, sixteen bit shift register, has a sixteen line input and a sixteen line output each connected to the data bus 60. The storage unit 90 is controlled by an address decoder 91 having an input connected to the control bus 45. Three temporary storage units 93, 94 and 95, each of which is a sixteen bit, one word shift register in this embodiment, are each connected to the data bus 60 by sixteen lines. Each of the temporary storate units 93, 94 and 95 are controlled by an address decoder 97 which is connected to the control bus 45.

A multiplier 100 includes an X input register connected to the data bus 60 by twelve lines, a Y input register connected to the data bus 60 by sixteen lines and a product output register connected to the data bus 60 by sixteen lines. The multiplier 100 is controlled by a multiplier control circuit 101 having an input connected to the control bus 45. The multiplier 100 may be, for example, a multiplier similar to the high speed multiplier disclosed in the copending U.S. patent application entitled "High Speed N by M Bit Digital Repeated Addition Type Multiplying Circuit", bearing Ser. No. 198,688, and filed Oct. 20, 1980. In the preferred embodiment, the multiplier 100 is a four by twelve multiplier which is clocked three times to complete a multiplication. While this makes the multiplier slower, it uses less area of a semiconductor chip. Also, the multiplier 100 has the additional feature that the X input can be loaded with a new number while the multiplication process is progressing.

An adder/subtractor 105 has input registers A and B each connected to the data bus 60 by sixteen lines and a sum output register connected to the data bus 60 by sixteen lines. The adder/subtractor is controlled by a control circuit 106 having an input connected to the control bus 45. The input registers A and B each have the additional feature that the positive or negative of an input number is available and can be used for addition or subtraction when desired. Thus, with two additional microcode destinations all of the adding and subtracting steps can be specified. This is a substantial advantage since no additional buses or connecting wires are required.

A voice output register 110 is connected to the data bus 60 for receiving and storing the reconstructed voice samples. The output register 110 is connected to additional circuitry for reproducing the voice by way of a twelve line output bus 111. The voice output register 110 is controlled by a control circuit 113 which is connected to the control bus 45 and also supplies a signal at an output terminal 115 when a new set of samples are going to be supplied at the output.

Figure 3:
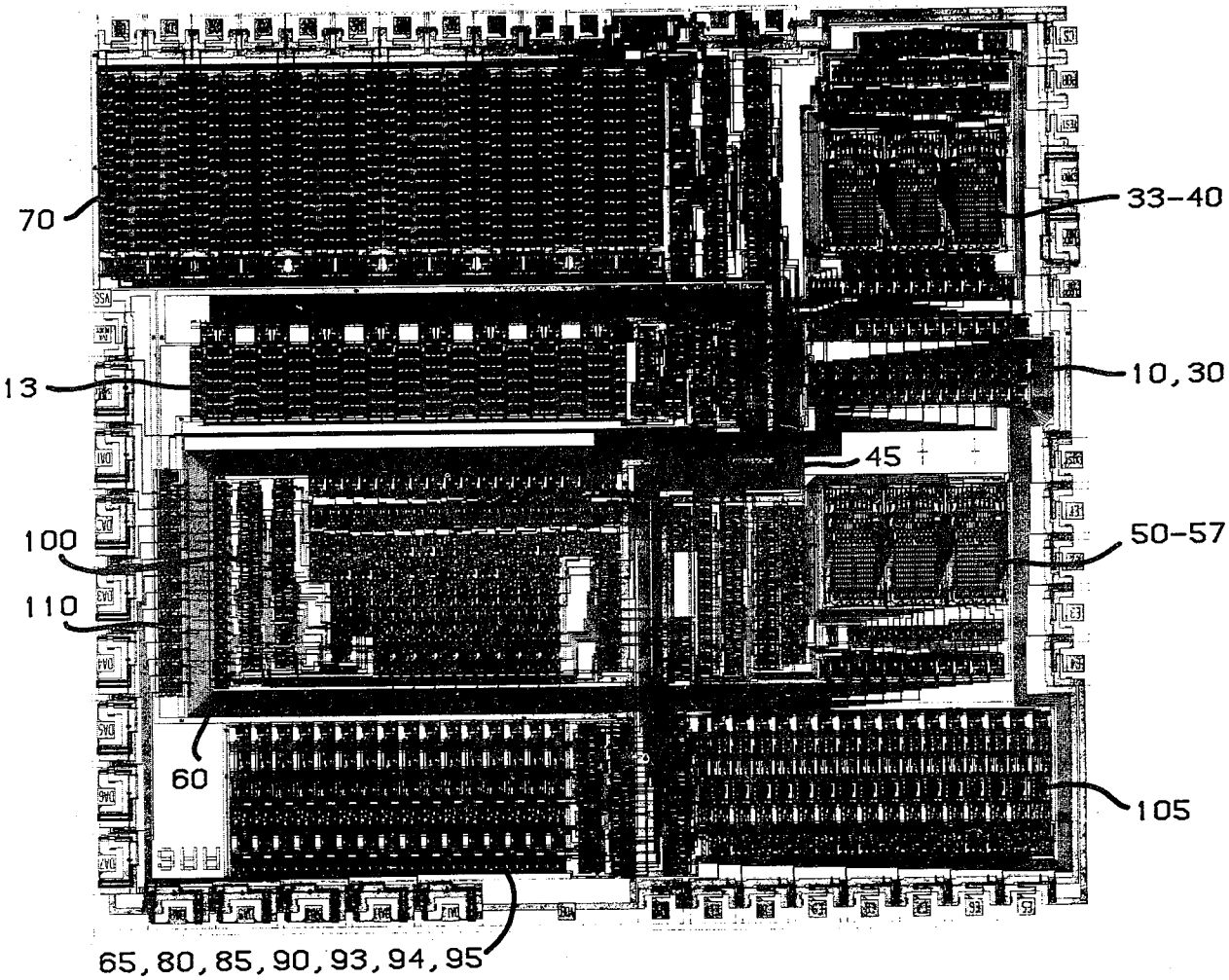
FIG. 3 is a plan view of a semiconductor chip containing the synthesizer of FIG. 2, showing the metal mask or metal pattern, and the silicon gate pattern.

All of the circuitry illustrated in block form in FIG. 2, in the preferred embodiment, is formed on a single semiconductor chip. A plan view of a semiconductor chip containing the synthesizer of FIG. 2, showing the metal mask or metal pattern, is illustrated in FIG. 3. The various areas of the semiconductor chip corresponding to the components of FIG. 2 are numbered with similar characters to indicate their function. The use of a single semiconductor chip greatly reduces the power requirements and increases the speed of operation.

In the operation of the apparatus illustrated in FIG. 2, two basic bit rates, or modes of operation, are provided. The first mode is 2400 bits per second and the second mode is 9600 bits per second. The basic difference between the two modes is the type of excitation. In the higher bit rate mode the residual excitation is supplied from an external source by way of the twelve line bus number 11. In this mode of operation the actual residual excitation from a remote analyzer is supplied for each voice sample that is reconstructed. In the lower bit rate mode the residual excitation is generated internally. The voiced or unvoiced excitation is controlled by circuit 62 through control of multiplexer 47 and counter 55. As is well known in the art, the PN counter 50 provides excitation for sounds such as the S in sing, the SH in sheet, the F in finger, and the $\theta$ in thing. The register 53, counter 55 and ROM 57 provide the excitation in sounds such as the AE in cat. It will of course be understood that any amount of mixing of the two types of excitation may be provided to improve the accuracy of other types of sound. For example, in the sounds Z as in zinc, TH as in the, V as in vary, and ZH and in azure it is necessary to mix fifty percent of the excitation from the PN counter 50 and fifty percent of the output of the pitch ROM 57. A further example is the i sound as in heat requires a mixing of ninty-five percent of the output of the pitch ROM 57 with five percent of the output of the PN counter 50. In addition to mixing various amounts of the internally generated excitation, it will be obvious to those skilled in the art that other bit rates might be utilized if desired.

To understand the step by step operation of the circuitry illustrated in FIG. 2, it is desirable to supply a microcode specifying the operation, which microcode is listed below.

| SOURCES | | |
|---|---|---|
| OKI | EQU 0 | OLD PARAMETER 15 WORD SHIFT REG ; GA, RC12-1, RMS, PITCH |
| NKI | EQU 1 | NEW PARAMETER S.R, READ SHIFTS OKI,NEWKI, +INPUT FIFO |
| CONST | EQU 2 | 1/180 1/90 1/45 OR .999 DEPENDING ON 68000 INTERPOLATION CONTROL BITS |
| S | EQU 4 | SUM OF A PLUS OR MINUS B WITH OVERFLOW PROTECT |
| 2S | EQU 5 | 2 TIMES SUM OF A+or−B WITH OVERFLOW PROTECT |
| P | EQU 6 | PRODUCT OF X*Y (NOTE P > Y ILLEGAL) |
| ROUND | EQU 7 | ROUND OFF CONSTANT |
| BR | EQU 9 | BACKWARD RESIDUAL 12 WORD SHIFT REGISTER |
| EXCT | EQU 10 | INTERNAL OR EXTERNAL EXCITATION DEPENDING ON 68000 |
| T2 | EQU 11 | TEMPORARY STORAGE |

-continued

```
T1      EQU 12      INTERPOLATION COEF. RESET BY 68000
                    FOLLOWING XFER IN PROGRESS
FR      EQU 13      FORWARD RESIDUAL
NOP     EQU 14
STE     EQU 15      SPECIAL TEST
```

DESTINATIONS

```
A+      EQU 0       A REGISTER OF ADDER,MASTER SLAVE,LOAD
                    ONLY,
                    ;ADDITION PROCEEDS AFTER XFER TO A OR B
                    ;WITH ADD SUBTRACT CONTROL AS SET BY LAST
                    ;XFER
A−      EQU 1       LOAD A AND SET SUBTRACT CONTROL LINE
+B      EQU 2       B REGISTER OF ADDER,LATCH,LOAD ONLY,
−B      EQU 3       ALSO SETS ADD-SUBTRACT CONTROL BIT
Y*      EQU 5       XFER TO Y STARTS MULTIPLY,Y IS 16 BITS
                    ;X PIPE IS TRANSFERRED TO X MULTIPLY
                    ;REGISTER DURING Y STROBE
X       EQU 6       X PIPE REGISTER OF MULTIPLY 12 BIT SIDE
T1,X    EQU 7
BR      EQU 8       BACKWARD RESIDUAL 12 WORD SHIFT REGISTER
OUT     EQU 9       SPEECH OUTPUT PORT
T2      EQU 10      TEMPORARY STORAGE
PITCH   EQU 11      PITCH CONTROL REG.
T1      EQU 12      INTERPOLATION PERCENTAGE
FR      EQU 13      FORWARD RESIDUAL REGISTER
NOP     EQU 15
```

CONDITIONS

```
DANR    EQU 1       DA NOT READY, SETS OR RESETS XFER IN
                    ;PROGRESS LATCH RESETS PITCH PERIOD
                    ;COUNTER IF CHIRP ADDRESS.GE. PITCH
                    ;CONTROL REGISTER
NTN     EQU 2       NOT 12 LOOPS
```

FIELDS

```
MOVE:   0000000 /4:SOURCE/ /4:DESTINATION/
JUMP:   0000001 /6:ADDRESS/ /2: CONDITION/
```

MICROCODE

```
        ORG 0       LOADS AT ADDRS 256 OF ROM
0 POR:  EXCT > NOP
 1 WAIT: JIF DANR WAIT  RESET LOOP COUNTER,WAIT FOR 8KHZ
                    ;CLK SAMPLE PARAMETER FIFO
                    ;COUNTER+POSSIBLY SET XFER IN
                    ;PROGRESS
                    ;RESET CHIRP ADDRESS COUNTER IF
                    ;.GE.
                    ;THAN INTERPOLATED PITCH VALUE
                    ;(PITCH REGISTER)
 2      CONST > +B
 3      T1 > A+     68000 TRANSFER RESETS T1
 4      S > T1,X    INCREMENT INTERPOLATION COUNTER
 5      OKI > −B    INTERPOLATE GA
 6      NKI > A−    NGA-OGA
 7      S > Y*      START N%180*(NGA-OGA)
 8      NOP > NOP
 9      NOP > NOP
10      EXCT > X    X MUST BE PIPIED,CLOCK CHIRP ADDRS
                    CNTR AND FN CNTR
11      P > A+      N/180*(NGA-OGA) > A
12      S > Y*      SCALE EXCITATION BY INTERPOLATED GA
13      NOP > NOP
14      NOP > NOP
15      T1 > X
16      P > FR
17 LOOP: OKI > −B   INTERPOLATE RC VALUE
18      NKI > A−    SHIFT OKI,NKI,AND INPUT FIFO ON
                    NKI XFER
19      S > Y*      START N%180(NEWKI-OLDKI)
20      NOP > NOP
21      NOP > NOP
22      NOP > NOP
23      P > A+      N%180(NKI-OKI) > A+
24      2S > X      2S = INTERPOLATED RC
25      BR > Y*
26      NOP > NOP
27      NOP > NOP
28      FR > +B
29      P > A+      BR*RC+FR > FR
30      S > Y*
31      S > FR
```

-continued

| | | |
|---|---|---|
| 32 | TI > X | |
| 33 | BR > A− | |
| 34 | P > −B | |
| 35 | S > BR | |
| 36 | JIF NTN LOOP | JUMP IF NOT 12 TIMES THROUGH LOOP<br>;-8; INCREMENT LOOP COUNTER<br>;AFTER THIS INSTRUCTION |
| 37 | OKI > −B | INTERPOLATE RMS |
| 38 | NKI > A− | |
| 39 | S > Y* | |
| 40 | FR > BR | |
| 41 | NOP > NOP | |
| 42 | NOP > NOP | |
| 43 | P > A+ | N/180*(NRMS-ORMS) > A |
| 44 | S > X | OLD+N%180(NRMS-ORMS) > X |
| 45 | FR > Y8 | |
| 46 | NOP > NOP | |
| 47 | TI > X | |
| 48 | ROUND > +B | |
| 49 | P > A+ | |
| 50 | S > OUT | |
| 51 | OKI > −B | INTERPOLATE PITCH |
| 52 | NKI > A− | |
| 53 | S > Y* | |
| 54 | NOP > NOP | |
| 55 | NOP > NOP | |
| 56 | NOP > NOP | |
| 57 | P > A+ | N%180(NEWPITCH-OLDPITCH) > A |
| 58 | S > PITCH | |
| 59 | JMP WAIT | |

The above microcode includes the numbers 1 through 59 in a column at the extreme left, which numbers indicate 59 steps of operation and each of these steps will be referred to by these numbers throughout this description. A 0 step is included at the beginning of the program to indicate that whenever the power on reset (terminal 34 of FIG. 3) is activated the thirteen stages of the PN counter 50 will be loaded with 1's to prevent the PN counter from locking up, which could occur if all 0's should appear in the thirteen stages. Step 1 is provided to allow transfer of data into the synthesizer from the prior equipment, which may be a processor such as the 68000 or the like. When all of the required information is transferred into the synthesizer the microcode is ready for operation.

In step number 2 the proper interpolation factor (1/180 in this example) is transferred from the circuit 65 to the positive B input register of the adder/subtractor 105. In the third step a number representative of the specific sample of the 180 samples in the frame being operated upon is transferred from the first temporary register 94 to the positive A input register of adder/subtractor 105. The sum in the output register of the adder/subtractor 105 is transferred to the first temporary register 94 and to the X input register of the multiplier 100 in the fourth step. The gain factor, GA, the correlation coefficients 9 through 1, the RMS figure and the pitch figure are stored in the new parameter storage unit 80 by way of the multiplexer 71. After 180 voice samples are reconstructed the parameters in the storage unit 80 are transferred to the storage unit 85 and new parameters are brought in from the RAM 70. This transfer of data is accomplished during the first step of the program. In step 5 the old gain factor from the storage unit 85 is transferred to the −B input register of the adder/subtractor 105. In step 6 the new gain factor is transferred from the storage unit 80 to the A input register of the adder/subtractor 105 and a subtraction is initiated. In step 7 the difference is transferred from the output register of the adder/subtractor 105 to the Y input of the multiplier 100 and a multiplication process is initiated, which process continues through steps 8 and 9. In step 10 the multiplication process continues and an excitation signal is transferred to the X input register of the multiplier 100. The excitation transferred to the X register depends upon the particular mode of operation of the system and may be either external excitation from the input register 10 or internal excitation from some combination of the PN counter 50 and pitch ROM 57 as described above.

On the 11th step the multiplication process is completed and the product is transferred from the output register of the multiplier 100 to the A input register of the adder/subtractor 105. The product is added to the old gain factor previously in the B input register (step 5) of the adder/subtractor 105 and the sum in the output register is transferred to the Y input register of the multiplier 100 and a multiplication process is started which will result in a first interpolated step of the gain factor. The multiplication process continues through steps 13, 14 and 15. While the multiplication is in process, during step 15, the interpolation increment stored in the first temporary register 94 during step 4 is transferred into the X input register of the multiplier 100. In step 16 the value of the excitation multiplied by the interpolated gain factor is available at the output register of the multiplier 100 and is transferred to the storage unit 93 as a forward residual signal. This forward residual signal is the output of the multiplier 13 in FIG. 1 and is now ready to be operated upon by the ten stage lattice filter.

Each time the system cycles through steps 17 to 36 represents a stage of the lattice filter. In the microcode set forth above twelve stages of the microcode filter are set forth to indicate that additional stages of filtering can be added if desired, while only ten stages are illustrated in FIG. 1 to indicate a minimum number of stages in the preferred embodiment. It will of course be understood by those skilled in the art that more or less stages can easily be added, as illustrated by the microcode.

In step 17 of the microcode the tenth (assuming only ten stages are utilized) old correlation coefficient is transferred from the storage unit 85 to the negative B input register of the adder/subtractor 105. In step 18 the tenth new correlation coefficient is transferred from the storage unit 80 to the A input register of the adder/subtractor 105 and a subtraction process is completed. In step 19 the difference available in the output register of the adder/subtractor 105 is transferred to the Y input register of the multiplier 100 and a multiplication process is started. This multiplication process is the interpolated value of the difference between the new and old correlation coefficients. During steps 20, 21 and 22 the multiplication process continues and in step 23 the product from the output register of the multiplier 100 is transferred to the A input register of the adder/subtractor 105 for addition to the value of the old correlation coefficient in the B input register (step 17). The sum is shifted one position (multiplied by two) and transferred from the output register of the adder/subtractor 105 to the X input register of the multiplier 100. In step 25 the tenth backward residual signal is transferred from the storage unit 90 to the Y input register of the multiplier 100 and a multiplication process is started. The multiplication process continues through steps 26, 27 and 28. It should be noted that the backward residual storage unit 90 provides the one sample time delay ($Z^{-1}$) and operates as the delay network 22, etc., in each of the ten stages. The use of a shift register as a delay network, rather than a random access memory or other type of delay network, eliminates the need for address calculation arithmetic and other additional circuitry.

In step 28, while the multiplication process is continuing, the forward residual signal from the storage unit 93 is transferred to the +B input register of the adder/subtractor 105. In step 29 the product from the output register of the multiplier 100 is transferred to the A input register of the adder/subtractor 105 and the sum, which is the output of the combining device 16 in FIG. 1, is transferred from the output register of the adder/subtractor 105 to the Y input register of the multiplier 100. Step 30 starts a multiplication process which is represented by the multiplier 19 in FIG. 1. The multiplication process continues through steps 31, 32 and 33. Also, in step 31 the sum from the output register of the adder/subtractor 105 is transferred to the storage unit 93 as the forward residual signal to be supplied to the next stage. In step 32 the interpolation increment stored in the first temporary storage unit 94 is transferred to the X input register of the multiplier 100. In step 33 the backward residual signal is transferred from the storage unit 90 to the A input register of the adder/subtractor 105 and a subtraction process is indicated. In step 34 the product from the output register of the multiplier 100 (the output of multiplier 19 in FIG. 1) is transferred to the negative B input register of the adder/subtractor 105 and the combination indicated by the combining circuit 25 of FIG. 1 is performed. The difference signal (output of the combiner 25 in FIG. 1) available in the output register of the adder/subtractor 105 is transferred to the backward residual storage unit 90 for storage until the next cycle through the loop.

An entire stage of filtering has now been completed and the 36th step of the microcode indicates that the process will return to step 17 if the required number of stages of filtering has not been completed. Upon completion of the required number of filtering cycles or stages the microcode proceeds to step 37.

In step 37 the old RMS value is transferred from the storage unit 85 to the −B input register of the adder/subtractor 105. In step 38 the new RMS value is transferred from the storage unit 80 to the A input register of the adder/subtractor 105 and a difference signal is available in the output register. In step 39 the difference signal from output register of the adder/subtractor 105 is transferred to the Y input register of the multiplier 100 and a multiplication process is started with the number already in the X input register from step 32. The multiplication process continues through steps 40, 41 and 42. Also, in step 40 the signal stored in the forward residual temporary storage unit 93 is transferred to the correct word storage area of the backward residual storage unit 90. In step 43 the product is available at the output register of the multiplier 100 and is transferred to the A input register of the adder/subtractor 105. This product is added to the old RMS value which was already in the negative B input register of the adder/subtractor 105 (step 37) and the sum is transferred from the output register of the adder/subtractor 105 to the X input register of the multiplier 100 in step 44. In step 45 the forward residual signal is transferred from the temporary storage unit 93 to the Y input register of the multiplier 100 and a multiplication process is started, which continues through steps 46, 47 and 48. The product which is transferred to the A input register of the adder/subtractor 105 in step 49 is the output of the multiplier 27 in the flowchart of FIG. 1.

While the multiplication process is continuing, in step 47 the signal stored in the first temporary register 94 is transferred to the X input of the multiplier 100. In step 48 a round off constant is transferred to the negative B input register of the adder/subtractor 105. During the multiplication processes it is necessary to drop some of the least significant bits or the size of the multiplier and associated registers would be prohibitive. In dropping some of the least significant bits (rounding off the number) a register nearly full of 1's will sometimes appear to be a zero which creates a substantial error in the calculation. To eliminate this error the round off constant is introduced in step 48. This round off error is added to the product in step 49 and the sum is transferred to the output register 110 in step 50.

In step 51 the old pitch signal is transferred from the storage unit 85 to the negative B input register of the adder/subtractor 105. In step 52 the new pitch signal is transferred from the storage unit 80 to the A input register of the adder/subtractor 105 and a difference signal is available at the output register. In step 53 the difference signal available at the output register is applied to the Y input register of the multiplier 100 and a multiplication process is started. The multiplication process continues through steps 54, 55 and 56 and the product is available at the output register in step 57. In step 47 the product is transferred to the A input register of the adder/subtractor 105 and is added to the old pitch signal already in the B register from step 51. The sum signal in the output register of the adder/subtractor 105 is transferred to the output register 110 in step 58. The output register 110 now has a complete voice sample available for transfer to the following equipment. In step 59 the microcode jumps to step 1 and starts the process again for the next sample. In the specific example disclosed the microcode process is repeated 180 times for each new set of parameters introduced into the storage unit 80. Because all of the parameters are interpolated into 180 steps the voice samples produced are a smoothly varying reconstruction of the original voice. Further, because the entire synthesizer is formed on a single semiconductor substrate, the synthesizer is extremely fast and efficient.

While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

I claim:

1. In a speech synthesizer including an all-pole, multistage lattice filter for reconstructing a plurality N of speech samples from each set of correlation coefficients and accompanying excitation signal applied thereto, smooth interpolation apparatus comprising:

(a) new parameter storage means for receiving and storing each new set of correlation coefficients;

(b) old parameter storage means connected to said new parameter storage means for receiving each of the sets of correlation coefficients subsequent to the reconstruction of the N speech samples therefrom; and (c) circuit means connected to said new and old parameter storage means for determining the difference between each new and old correlation coefficient in the new and old sets, separating the difference into N steps and providing a correlation coefficient which changes in the N steps from the old correlation coefficient to the new correlation coefficient.

2. The smooth interpolation apparatus as claimed in claim 1 wherein the new and old parameter storage means include shift registers.

3. The smooth interpolation apparatus as claimed in claim 1 wherein the speech synthesizer is formed as an integrated circuit on a single semiconductor chip.

4. The smooth interpolation apparatus as claimed in claim 1 wherein the circuit means performs the required functions in accordance with the equation $$K_T = K_I\,\text{old} + (K_I\,\text{new} - K_I\,\text{old})n/N$$

where:

$K_T$ is the changing correlation coefficient, $K_I$ old is the old correlation coefficient, $K_I$ new is the new correlation coefficient, N is the number of samples to be reconstructed for each set of correlation coefficients, and n is the particular sample of the N samples being reconstructed.

5. A speech synthesizer formed as an integrated circuit on a single semiconductor chip comprising:

(a) excitation input means connected to receive external signals for providing excitation signals;

(b) correlation coefficient input means;

(c) new parameter storage means connected to said correlation coefficient input means for receiving and storing each new set of correlation coefficients upon being operatively sequenced;

(d) old parameter storage means connected to said new parameter storage means for receiving each of the sets of correlation coefficients subsequent to reconstruction of N speech samples therefrom;

(e) a data bus and a control bus coupled to said excitation input means, said correlation coefficient input means, said new and said old parameter storage means;

(f) a multiplier coupled to said data and control buses;

(g) an adder/subtractor coupled to said data and control buses;

(h) a plurality of temporary storage units coupled to said data and control buses; and (i) sequencing circuitry coupled to said control bus for controlling each of said components in a predetermined sequence.

6. A speech synthesizer as claimed in claim 5 wherein the new and old storage means and the temporary storage units each include shift registers.

7. A speech synthesizer as claimed in claim 5 wherein the correlation coefficient input means includes a first-in first-out random access memory.

8. A speech synthesizer as claimed in claim 5 wherein the sequencing circuitry is programmable to synthesize speech in accordance with different methods including all-pole lattice filter, cascaded second order filter, direct form filter, and pole and zero filter.

9. In speech synthesis wherein a plurality N of speech samples are reconstructed from each set of correlation coefficients and accompanying excitation signal applied thereto, a method of smoothly interpolating the correlation coefficients comprising the steps of:

(a) storing a first, or old, set of correlation coefficients;

(b) receiving a second, or new, set of correlation coefficients;

(c) determining the difference between the new and the old correlation coefficients; and (d) developing a new set of correlation coefficients which changes 1/Nth of the difference from the old to the new correlation coefficients for each of the N samples reconstructed.

* * * * *